US008463446B2

(12) United States Patent
Borgmann et al.

(10) Patent No.: US 8,463,446 B2
(45) Date of Patent: Jun. 11, 2013

(54) OPERATING METHOD FOR A COOLING SECTION HAVING CENTRALIZED DETECTION OF VALVE CHARACTERISTICS AND OBJECTS CORRESPONDING THERETO

(75) Inventors: Udo Borgmann, Röttenbach (DE); Markus Forsch, Mobile, AL (US); Stefan Schmors, Worpswede (DE); Klaus Weinzierl, Nürnberg (DE)

(73) Assignee: Siemens Aktiengesellschaft, Munich (DE)

( * ) Notice: Subject to any disclaimer, the term of this patent is extended or adjusted under 35 U.S.C. 154(b) by 337 days.

(21) Appl. No.: 12/679,981

(22) PCT Filed: Sep. 2, 2008

(86) PCT No.: PCT/EP2008/061551
§ 371 (c)(1),
(2), (4) Date: Jun. 14, 2010

(87) PCT Pub. No.: WO2009/043668

PCT Pub. Date: Apr. 9, 2009

(65) Prior Publication Data

US 2010/0312399 A1 Dec. 9, 2010

(30) Foreign Application Priority Data

Sep. 27, 2007 (DE) ..... 10 2007 046 279

(51) Int. Cl.

| | |
|---|---|
| ***G05D 7/00*** | (2006.01) |
| ***G01F 1/00*** | (2006.01) |
| ***G01F 25/00*** | (2006.01) |
| ***G01D 18/00*** | (2006.01) |
| ***F17D 3/00*** | (2006.01) |
| ***E03B 1/00*** | (2006.01) |
| ***F16K 1/00*** | (2006.01) |

(52) U.S. Cl.
USPC ..... 700/282; 702/45; 702/85; 702/100; 137/2; 137/9; 137/614; 137/861

(58) Field of Classification Search
CPC ..... G01F 25/0007; G01F 15/005; G01F 1/68
USPC ..... 72/201; 700/282; 702/45, 85, 100; 137/2, 9, 613, 614, 861
See application file for complete search history.

(56) References Cited

U.S. PATENT DOCUMENTS

| | | | | |
|---|---|---|---|---|
| 3,300,198 | A | 1/1967 | Clumpner et. al. | |
| 4,569,023 | A * | 2/1986 | Wakamiya | 700/153 |

(Continued)

FOREIGN PATENT DOCUMENTS

| | | |
|---|---|---|
| DE | 19854675 | 6/2000 |
| EP | 0280259 | 8/1988 |

(Continued)

OTHER PUBLICATIONS

Guo, "Modeling and Simulation of Run-Out table Cooling Control Using Feedforward-Feedback and Element Tracking System", IEEE Transaction on Industry Applications, vol. 33, No. 2, Mar./Apr. 1997, pp. 304-311 (8 pages).

*Primary Examiner* — Kavita Padmanabhan
*Assistant Examiner* — Darrin Dunn
(74) *Attorney, Agent, or Firm* — King & Spalding L.L.P.

(57) ABSTRACT

In a cooling section having a plurality of coolant outlets, the coolant outlets are supplied with the coolant via transmission lines and a mutual main line. Individually opening and closing valves are disposed in the transmission lines. An automation device of the cooling section opens and closes the valves at valve-specific opening and closing times during the normal operation of the cooling section in order to apply coolant to the rolling stock according to a quantitative target coolant course. During the determination of the opening times, the automation device considers a respective valve-specific characteristic. In calibration operation of the cooling section, the respective characteristic is initially determined at least for some of the valves by opening and closing the respective valve, and detecting the chronological course of the quantitative coolant flow effected thereby by a measuring arrangement disposed in the main line.

11 Claims, 7 Drawing Sheets

U.S. PATENT DOCUMENTS

| | | | | |
|---|---|---|---|---|
| 4,932,232 | A | 6/1990 | Ballyns et al. | 72/201 |
| 6,225,609 | B1 * | 5/2001 | Imanari et al. | 219/494 |
| 6,237,385 | B1 * | 5/2001 | Stodt | 72/201 |
| 6,782,906 | B2 * | 8/2004 | Chang | 137/10 |
| 2001/0037159 | A1 * | 11/2001 | Boger et al. | 700/52 |
| 2002/0161541 | A1 * | 10/2002 | Hou et al. | 702/105 |
| 2007/0095413 | A1 * | 5/2007 | Zhu et al. | 137/883 |
| 2008/0017320 | A1 * | 1/2008 | Choi et al. | 156/345.54 |
| 2008/0314367 | A1 * | 12/2008 | Goulette et al. | 123/472 |
| 2009/0194207 | A1 * | 8/2009 | Oda | 148/579 |
| 2010/0312399 | A1 | 12/2010 | Borgmann et al. | 700/282 |

FOREIGN PATENT DOCUMENTS

| | | | | |
|---|---|---|---|---|
| JP | 56168908 | | | 12/1981 |
| JP | 09308906 | A | * | 12/1997 |
| RU | 2067904 | C1 | | 10/1996 |
| SU | 1297960 | A1 | | 3/1987 |
| WO | 2009/043668 | A1 | | 4/2009 |

* cited by examiner 1
2
3
4
5
6
7
8
9
10
12
12a
12b
12x
13
14
15
15x
16
16'
16x
17
Q, Z
Q, Z
Q, Z
p, p'

OPERATING METHOD FOR A COOLING SECTION HAVING CENTRALIZED DETECTION OF VALVE CHARACTERISTICS AND OBJECTS CORRESPONDING THERETO

CROSS-REFERENCE TO RELATED APPLICATIONS

This application is a U.S. National Stage Application of International Application No. PCT/EP2008/061551 filed Sep. 2, 2008, which designates the United States of America, and claims priority to German Application No. 10 2007 046 279.6 filed Sep. 27, 2007, the contents of which are hereby incorporated by reference in their entirety.

TECHNICAL FIELD

The present invention relates to an operating method for a cooling section,

- wherein the cooling section has a plurality of coolant outlets, by means of which a coolant can be applied to a rolling stock passing through the cooling section during normal operation of the cooling section,
- wherein the coolant outlets are supplied with the coolant via supply lines,
- wherein the supply lines comprise branch lines, in each of which a valve is arranged,
- wherein the valves can individually open and close, so that by means of the valves the supply of coolant to the coolant outlets can be established and interrupted branch line by branch line,
- wherein the branch lines are supplied with the coolant via a main line shared by the branch lines,
- wherein an automation device of the cooling section opens and closes the valves at valve-specific opening times and at valve-specific closing times during normal operation of the cooling section in order to apply coolant to the rolling stock in accordance with a desired variation in coolant quantities,
- wherein, in the determination of the valve-specific opening times and the valve-specific closing times, the automation device takes a respective valve-specific characteristic into consideration.

The present invention also relates to an operating program which comprises machine code, the execution of which by an automation device for a cooling section has the effect that the automation device performs such an operating method. Furthermore, the present invention relates to a data carrier on which such an operating program is stored in a machine-readable form, and an automation device for a cooling section which is programmed with such an operating program, so that it performs such an operating method when the operating program is executed. Finally, the present invention relates to a corresponding cooling section.

BACKGROUND

In the area of hot rolling technology, defined cooling of the rolling stock in a cooling section is of great significance for allowing desired material properties (for example a microstructure) of the rolling stock running out from the cooling section to be reliably set. Consequently, correctly timed application of the coolant to the rolling stock in terms of location and quantity is of decisive significance for properly implemented cooling of the rolling stock in the cooling section. Consideration of the valve-specific characteristics is required for this. The valve-specific characteristics here particularly comprise a switch-on delay and a switch-off delay. In operational practice, the valve-specific characteristics change during operation. For example, the delays may be influenced by wear. Furthermore a valve-related average flow rate often also varies while operation is in progress. This variation may be caused, for example, by contaminants.

To the knowledge of the applicant, the determination of the switch-on delay and switch-off delay of one of the valves (known as dead time measurements) is currently carried out manually (by using a stopwatch). This involves the operator of the cooling section starting the stopwatch at the same time as a control signal for opening the respective valve occurs. He stops the stopwatch when, in his subjective judgement, the full amount of water is flowing onto the rolling stock or onto the roller table. This measured time is then considered to be the switch-on delay. In an analogous way, the operator of the cooling section determines a switch-off delay for the respective valve. The average amount of coolant that flows through the respective valve per unit of time is determined in the prior art by means of gaging the amount in liters. This measurement is very laborious and time-consuming and is generally only performed rarely. It generally requires auxiliary equipment adapted to the installation, such as for example water tanks.

In particular on account of the only relatively rare detection of the average flow rates, the actual valve-specific characteristics often no longer coincide in practice with the parameterized characteristics on the basis of which the valve-specific opening times and valve-specific closing times are determined in a cooling section model. Therefore, application of the coolant to the rolling stock is less than optimal, at the same time bringing about the effect that the rolling stock does not in fact end up with the desired product properties.

SUMMARY

According to various embodiments possible ways can be provided that can be used as a basis for determining the valve-specific characteristics.

According to an embodiment, in an operating method for a cooling section, wherein the cooling section has a plurality of coolant outlets, by means of which a coolant can be applied to a rolling stock passing through the cooling section during normal operation of the cooling section, the coolant outlets are supplied with the coolant via supply lines, the supply lines comprise branch lines, in each of which a valve is arranged, the valves can individually open and close, so that by means of the valves the supply of coolant to the coolant outlets can be established and interrupted branch line by branch line, the branch lines are supplied with the coolant via a main line shared by the branch lines, an automation device of the cooling section opens and closes the valves at valve-specific opening times and at valve-specific closing times during normal operation of the cooling section in order to apply coolant to the rolling stock in accordance with a desired variation in coolant quantities, in the determination of the valve-specific opening times and the valve-specific closing times, the automation device takes a respective valve-specific characteristic into consideration, and, during calibrating operation of the cooling section, the respective valve-specific characteristic is determined, at least for some of the valves, by opening and closing the respective valve and detecting the resultant variation over time of the quantitative coolant flow by means of a measuring arrangement arranged in the main line.

According to a further embodiment, the respective valve-specific characteristic may comprise a switch-on delay and/or a switch-off delay. According to a further embodiment, to determine the switch-on delay of one of the valves, the automation device may issue an opening command, with the respective valve closed, to the respective valve at a first activating time, wherein the quantitative coolant flow flowing in the main line is detected and wherein the switch-on delay is determined on the basis of the first activating time and the detected quantitative coolant flow. According to a further embodiment, to determine the switch-off delay of one of the valves, the automation device may issue a closing command, with the respective valve open, to the respective valve at a second activating time, wherein the quantitative coolant flow flowing in a main line is detected and wherein the switch-off delay is determined on the basis of the second activating time and the detected quantitative coolant flow. According to a further embodiment, the respective valve-specific characteristic may comprise an average quantitative coolant flow which, with the respective valve open, flows through the respective valve. According to a further embodiment, to determine the average quantitative coolant flow of one of the valves, the quantitative coolant flow flowing through the main line may repeatedly be detected during an opening time period and the average quantitative coolant flow can be determined by forming the mean value of the detected quantitative coolant flows. According to a further embodiment, to determine the average quantitative coolant flow of one of the valves, an amount of coolant that has flowed through the main line can be detected at the beginning and at the end of an opening time period and wherein the average quantitative coolant flow can be determined by forming the difference between the detected amounts of coolant and dividing the difference by the opening time period. According to a further embodiment, during calibrating operation of the cooling section, a calibrating pressure prevailing in one of the supply lines can also be detected in addition to the quantitative coolant flow, wherein, during normal operation of the cooling section, the automation device detects a normal pressure prevailing in this supply line and wherein, in addition to the respective valve-specific characteristic, the automation device also takes the calibrating pressure and the normal pressure into consideration in the determination of the valve-specific opening times and the valve-specific closing times. According to a further embodiment, the main line has a measuring portion, the measuring portion has at least two individual portions flow-connected parallel to one another, one of which has a large cross section and the other has a small cross section, the measuring arrangement has a flow sensor, arranged in the individual portion with the small cross section, for detecting the quantitative coolant flow flowing in the individual portion with the small cross section, a main valve is arranged at least in the individual portion with the large cross section and wherein—preferably by corresponding activation by the automation device—at the beginning of normal operation of the cooling section the main valve is opened, during normal operation of the cooling section it is kept open and during calibrating operation of the cooling section it is closed, at least for a time, so that the quantitative coolant flow flowing in the main line with the main valve closed corresponds to the quantitative coolant flow flowing in the individual portion with the small cross section. According to a further embodiment, calibrating operation can be carried out by the automation device in an automated manner.

According to another embodiment, an operating program may comprise machine code, the execution of which by an automation device for a cooling section brings about the effect that the automation device performs an operating method as described above.

According to yet another embodiment, a data carrier may store an operating program as described above in a machine-readable form.

According to yet another embodiment, an automation device for a cooling section may be being programmed with an operating program as described above, so that it performs an operating method as described above when the operating program is executed.

According to yet another embodiment, a cooling section may have a plurality of coolant outlets, by means of which a coolant can be applied to a rolling stock passing through the cooling section during normal operation of the cooling section, wherein the coolant outlets can be supplied with the coolant via supply lines, wherein the supply lines comprise branch lines, in each of which a valve is arranged, wherein the valves can individually open and close, so that by means of the valves the supply of coolant to the coolant outlets can be established and interrupted branch line by branch line, wherein the branch lines can be supplied with the coolant via a main line shared by the branch lines, wherein an automation device of the cooling section is formed in such a way that it opens and closes the valves at valve-specific opening times and at valve-specific closing times during normal operation of the cooling section in order to apply coolant to the rolling stock in accordance with a desired variation in coolant quantities, wherein the automation device is formed in such a way that, in the determination of the valve-specific opening times and the valve-specific closing times, it takes a respective valve-specific characteristic into consideration, and wherein a measuring arrangement is arranged in the main line, so that, during calibrating operation of the cooling section, the respective valve-specific characteristic is determined for the valves by opening and closing the respective valve and detecting the resultant variation over time of the quantitative coolant flow in the main line.

According to a further embodiment of the cooling section, the respective valve-specific characteristic may comprise a switch-on delay and/or a switch-off delay. According to a further embodiment of the cooling section, the automation device can be formed in such a way that, to determine the switch-on delay of one of the valves, it issues an opening command, with the respective valve closed, to the respective valve at a first activating time, detects an opening time at which the quantitative coolant flow flowing in the main line rises above an upper threshold value, and determines the switch-on delay on the basis of the first activating time and the opening time. According to a further embodiment of the cooling section, the automation device can be formed in such a way that, to determine the switch-off delay of one of the valves, it issues a closing command, with the respective valve open, to the respective valve at a second activating time, detects a closing time at which the quantitative coolant flow flowing in the main line falls below a lower threshold value, and determines the switch-off delay on the basis of the second activating time and the closing time. According to a further embodiment of the cooling section, the respective valve-specific characteristic may comprise an average quantitative coolant flow which, with the respective valve open, flows through the main line. According to a further embodiment of the cooling section, the automation device may be formed in such a way that, to determine the average quantitative coolant flow of one of the valves, it detects the quantitative coolant flow flowing through the main line repeatedly during an opening time period and determines the average quantitative coolant flow by forming the mean value of the detected quantitative coolant flows. According to a further embodiment of the cooling section, the automation device may be formed in such a way that, to determine the average quantitative coolant flow of one of the valves, it detects an amount of coolant that has flowed through the main line at the beginning and at the end of an opening time period and determines the average quantitative coolant flow by forming the difference between the detected amounts of coolant and dividing the difference by the opening time period. According to a further embodiment of the cooling section, the automation device may be formed in such a way that, during calibrating operation of the cooling section, it also detects a calibrating pressure prevailing in one of the supply lines in addition to the quantitative coolant flow and, during normal operation of the cooling section, it also detects a normal pressure prevailing in this supply line and in addition to the respective valve-specific characteristic, it also takes the calibrating pressure and the normal pressure into consideration in the determination of the valve-specific opening times and the valve-specific closing times. According to a further embodiment of the cooling section, the automation device can be formed in such a way that calibrating operation is performed by it automatically. According to a further embodiment of the cooling section, the main line may have a measuring portion, the measuring portion may have at least two individual portions flow-connected parallel to one another, one of which has a large cross section and the other has a small cross section, the measuring arrangement may have a flow sensor, arranged in the individual portion with the small cross section, for detecting the quantitative coolant flow flowing in the individual portion with the small cross section and a main valve can be arranged at least in the individual portion with the large cross section, so that the quantitative coolant flow flowing in the main line with the main valve closed corresponds to the quantitative coolant flow flowing in the individual portion with the small cross section. According to a further embodiment of the cooling section, the automation device can be formed in such a way that it opens the main valve at the beginning of normal operation of the cooling line, keeps it open during normal operation of the cooling line and closes it, at least for a time, during calibrating operation of the cooling line.

BRIEF DESCRIPTION OF THE DRAWINGS

Further advantages and details emerge from the following description of exemplary embodiments in conjunction with the basic drawings, in which.

DETAILED DESCRIPTION

Figure 1:
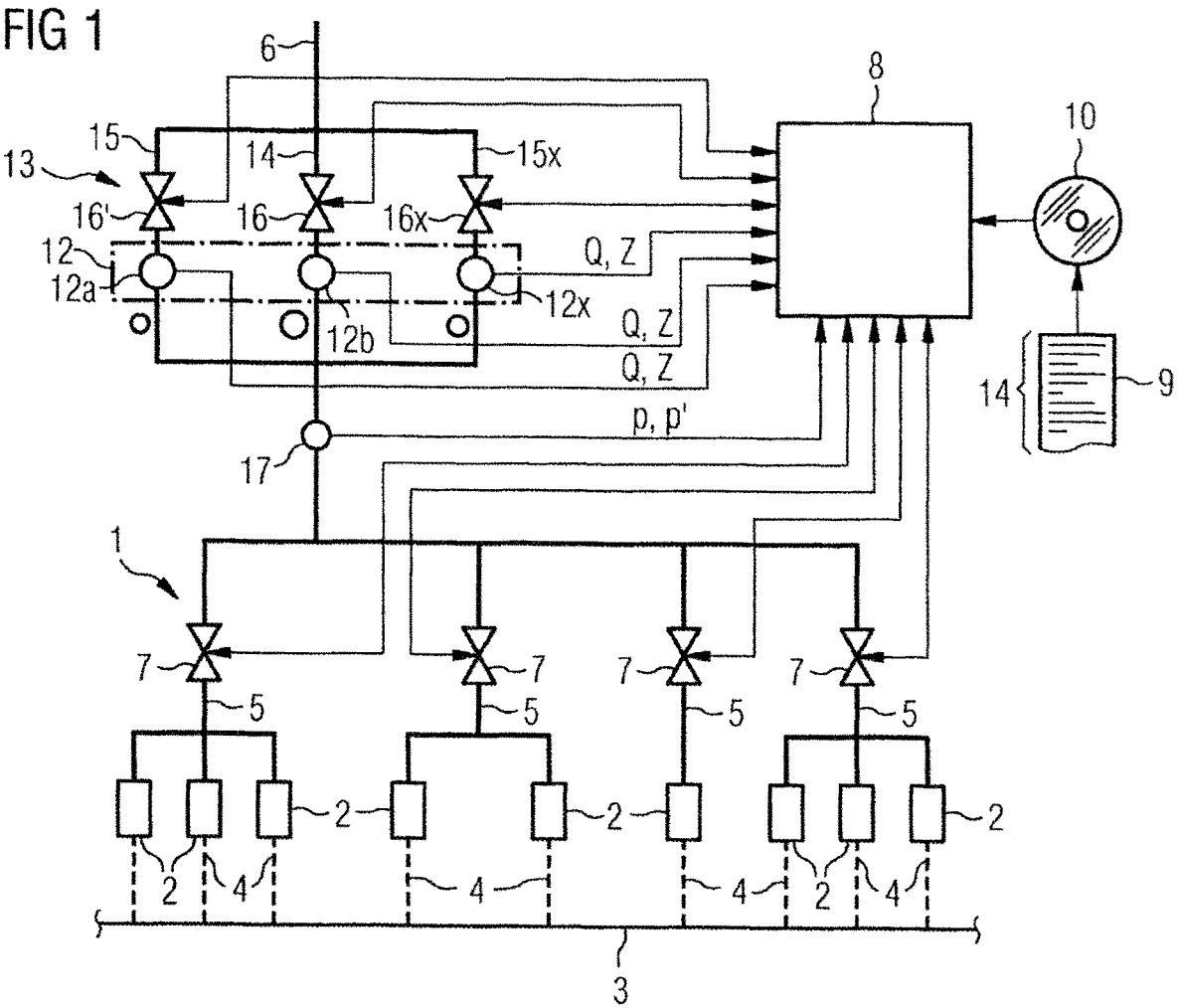
FIG. 1 shows a schematic representation of a cooling section.

According to various embodiments, during calibrating operation of the cooling section, the respective valve-specific characteristic is determined, at least for some of the valves, by opening and closing the respective valve and detecting the resultant variation over time of the quantitative coolant flow by means of a measuring arrangement arranged in the main line.

The respective valve-specific characteristic may, as already mentioned, particularly comprise a switch-on delay and/or a switch-off delay.

To determine the switch-on delay of one of the valves, the automation device issues an opening command, preferably with the respective valve closed, to the respective valve at a first activating time. Furthermore, in this case, the quantitative coolant flow flowing in the main line is detected. The switch-on delay is in this case determined on the basis of the first activating time and the detected quantitative coolant flow.

To determine the switch-off delay of one of the valves, the automation device may, in an analogous way, issue a closing command, with the respective valve open, to the respective valve at a second activating time. In this case, the quantitative coolant flow flowing in a main line is likewise detected. The switch-off delay is in this case determined on the basis of the second activating time and the detected quantitative coolant flow.

The respective valve-specific characteristic may, furthermore, comprise an average quantitative coolant flow which, with the respective valve open, flows through the respective valve. Two alternative procedures are possible for determining the average quantitative coolant flow.

On the one hand, it is possible that the quantitative coolant flow flowing through the main line is repeatedly detected during an opening time period and the average quantitative coolant flow is determined by forming the mean value of the detected quantitative coolant flows. Alternatively, an amount of coolant that has flowed through the main line may be detected at the beginning and at the end of an opening time period and the average quantitative coolant flow determined by forming the difference between the detected amounts of coolant and dividing the difference by the opening time period.

Preferably, during calibrating operation, a calibrating pressure prevailing in one of the supply lines is also detected in addition to the quantitative coolant flow. Furthermore, in the case of this refinement, during normal operation, the automation device detects a normal pressure prevailing in this supply line. In this case, in addition to the respective valve-specific characteristic, the automation device may also take the calibrating pressure and the normal pressure into consideration in the determination of the valve-specific opening times and the valve-specific closing times. The supply line of which the pressure is detected does not have to be identical here to the main line of which the quantitative coolant flow is detected (even though this is of course possible). It is sufficient that, if different supply lines are concerned, the supply lines are connected to one another in a communicating manner. By taking the calibrating pressure and the normal pressure into consideration, a dynamic adaptation of the valve-specific opening times and the valve-specific closing times to the current operating state of the cooling section can be performed.

In an embodiment, the main line has a measuring portion, which has at least two individual portions flow-connected parallel to one another. Of the individual portions, one has a large cross section and the other has a small cross section. The measuring arrangement has a flow sensor, arranged in the individual portion with the small cross section, for detecting the quantitative coolant flow flowing in this individual portion. Furthermore, a main valve is arranged at least in the individual portion with the large cross section. At the beginning of normal operation of the cooling section, the main valve is opened. During normal operation of the cooling section, the valve is kept open. During calibrating operation of the cooling section, on the other hand, the main valve is closed, at least for a time, so that the quantitative coolant flow flowing in the main line with the main valve closed corresponds to the quantitative coolant flow flowing in the individual portion with the small cross section. This procedure allows the flowing quantitative coolant flows to be detected relatively accurately in an easy way. Preferably, the opening and closing of the main valve is performed here by means of a corresponding activation by the automation device.

In an embodiment, the calibrating operation is carried out by the automation device in an automated manner.

According to FIG. 1, a cooling section 1 has a plurality of coolant outlets 2. By means of the coolant outlets 2, a coolant 4 can be applied to a rolling stock 3, which passes through the cooling section 1, during normal operation of the cooling section 1. The coolant 4 is generally water, or at least contains water as a main constituent.

The coolant outlets 2 are supplied with the coolant 4 via supply lines 5, 6. The supply lines 5, 6 comprise branch lines 5 and a main line 6. The branch lines 5 are supplied with the coolant 4 via the main line 6. The main line 6 is shared here by the branch lines 5.

Arranged in the branch lines 5 are valves 7, which can be individually opened and closed. By means of the valves 7, the supply of coolant 4 to the coolant outlets 2 can be established and interrupted branch line by branch line. According to FIG. 1—purely by way of example—two of the valves 7 are used to actuate three coolant outlets 2, two of the coolant outlets 2 by means of one of the valves 7 and one of the coolant outlets 2 by means of one of the valves 7. However, this refinement is given purely by way of example. Generally, the same number of coolant outlets 2 are actuated by means of each of the valves 7, that is to say for example always two or three coolant outlets 2.

The cooling section 1 has an automation device 8, which determines the operating mode of the cooling section 1. The automation device 8 is generally software-programmable. The operating mode of the automation device 8 is in this case determined by an operating program 9, which is fed to the automation device 8 via a computer network (not represented, for example the Internet) or a mobile data carrier 10 (for example a CD-ROM). The operating program 9 is optionally stored here on the mobile data carrier 10 in a machine-readable form. By feeding the operating program 9 to the automation device 8, the automation device 8 is programmed with the operating program 9.

The operating program 9 comprises machine code 11, the execution of which by the automation device 8 brings about the effect that the automation device 8 performs an operating method which is explained in detail below in conjunction with FIG. 2 and the further figures.

Figure 2:
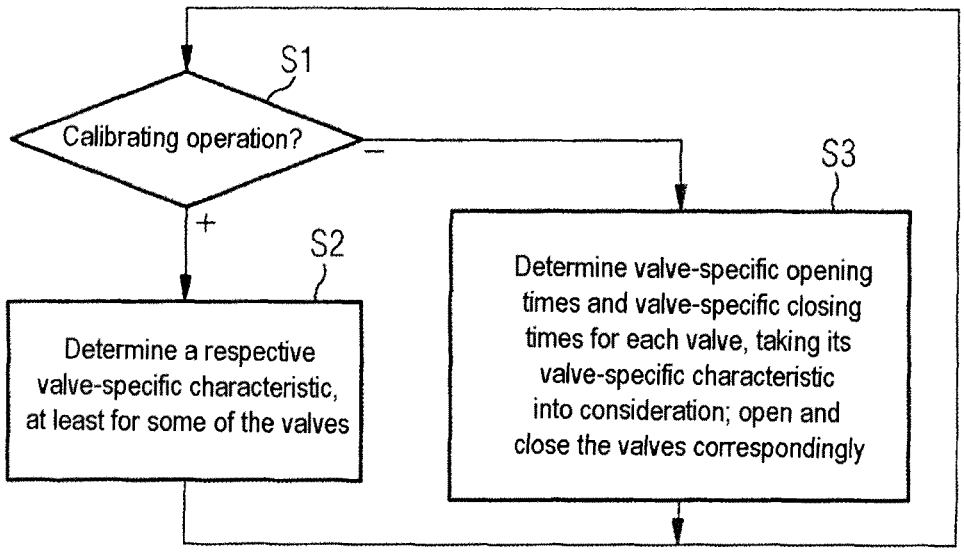
FIGS. 2 and 3 show flow diagrams.

According to FIG. 2, the automation device 8 checks in a step S1 whether it should assume calibrating operation. If this is the case, the automation device 8 performs a step S2. Otherwise, the automation device 8 is in normal operation. In this case, it performs a step S3.

In step S2, a respective valve-specific characteristic is determined, at least for some of the valves 7 (generally for all of the valves 7). The determination of the valve-specific characteristics is preferably performed here automatically by the automation device 8. It may, however, also—at least partially—take place manually.

The determination of the valve-specific characteristic comprises—for each valve 7 of which the characteristic is to be determined—the opening and closing of the respective valve 7 and (as a result) the detection of a resultant variation over time of the quantitative coolant flow Q in the respective supply line 5, 6.

In step S3, the automation device 8 determines (for example as part of a cooling section model) valve-specific opening times and valve-specific closing times for each valve 7. It takes into consideration here in the determination of the valve-specific opening times and the valve-specific closing times the respective valve-specific characteristic of the respective valve 7. Furthermore, the automation device 8 opens and closes the valves 7 at the respective valve-specific opening times and closing times. This achieves the effect that coolant 4 is applied to the rolling stock 3 in accordance with a desired variation in coolant quantities.

The refinement of step S3 is known per se. Therefore, no further explanation of step S3 is given.

It is possible that the respective valve-specific characteristic of a valve 7 comprises a switch-on delay T1 and a switch-off delay T2. In this case, the step S2 from Figure may, for example, comprise a procedure such as that explained in more detail below in conjunction with FIG. 3.

Figure 4:
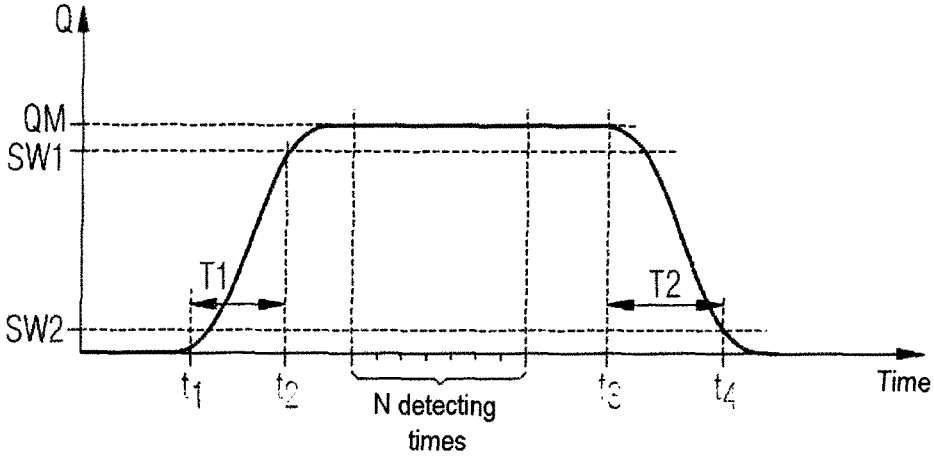
FIG. 4 shows a time diagram.
Figure 3:
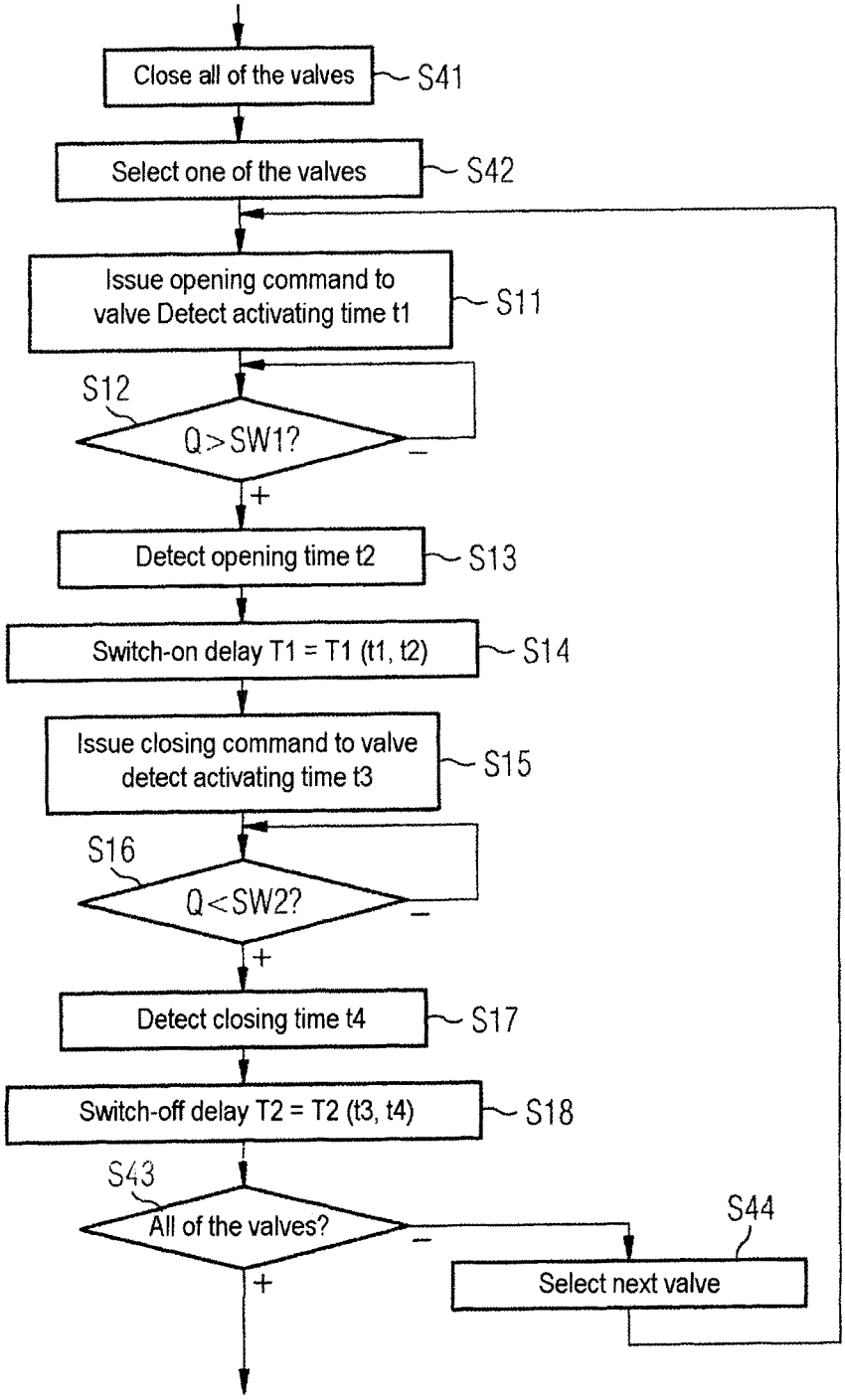

According to FIG. 3 (also compare FIG. 4), to determine the switch-on delay T1 of one of the valves 7, the automation device 8 issues an opening command, in a step S11, with the respective valve 7 closed, to the respective valve 7 at a first activating time t1.

In a step S12, the automation device 8 checks whether the quantitative coolant flow Q flowing in the corresponding supply line 5, 6 has already reached an upper threshold value SW1. Step S12 is performed until the quantitative coolant flow Q rises above the upper threshold value SW1. Then a transition is made to a step S13, in which the automation device 8 detects the corresponding time t2, subsequently referred to as opening time t2.

In a step S14, the automation device 8 determines the switch-on delay T1 on the basis of the first activating time t1 and the opening time t2. In the simplest case, it determines the switch-on delay T1 by forming the difference between the opening time t2 and the first activating time t1.

In a step S15, the automation device 8 then issues a closing command, with the respective valve 7 open, to the respective valve 7 at a second activating time t3.

In a step S16, the automation device 8 checks whether the quantitative coolant flow Q is less than a lower threshold value SW2. Step S16 is performed until the quantitative coolant flow Q falls below the lower threshold value SW2. Then, the evaluation device 8 goes over to a step S17.

In a step S17, the automation device 8 detects the time t4 at which the quantitative coolant flow Q has fallen below the lower threshold value SW2. The time t4 is subsequently referred to as the closing time t4.

In a step S18, the automation device 8 determines the switch-off delay T2 on the basis of the second activating time t3 and the closing time t4. In the simplest case, the automation device 8 determines the switch-off delay T2 by forming the difference between the closing time t4 and the second activating time t3.

As an alternative or in addition to the switch-on delay T1 and the switch-off delay T2, the respective valve-specific characteristic may comprise an average quantitative coolant flow QM, which, with the respective valve 7 open, flows through the respective valve 7. In this case, as an alternative or in addition to the refinement from FIG. 3, the step S2 from FIG. 2 may be designed in a way corresponding to FIGS. 5 and 6. The refinements according to FIGS. 5 and 6 are alternatives here.

Figure 5:
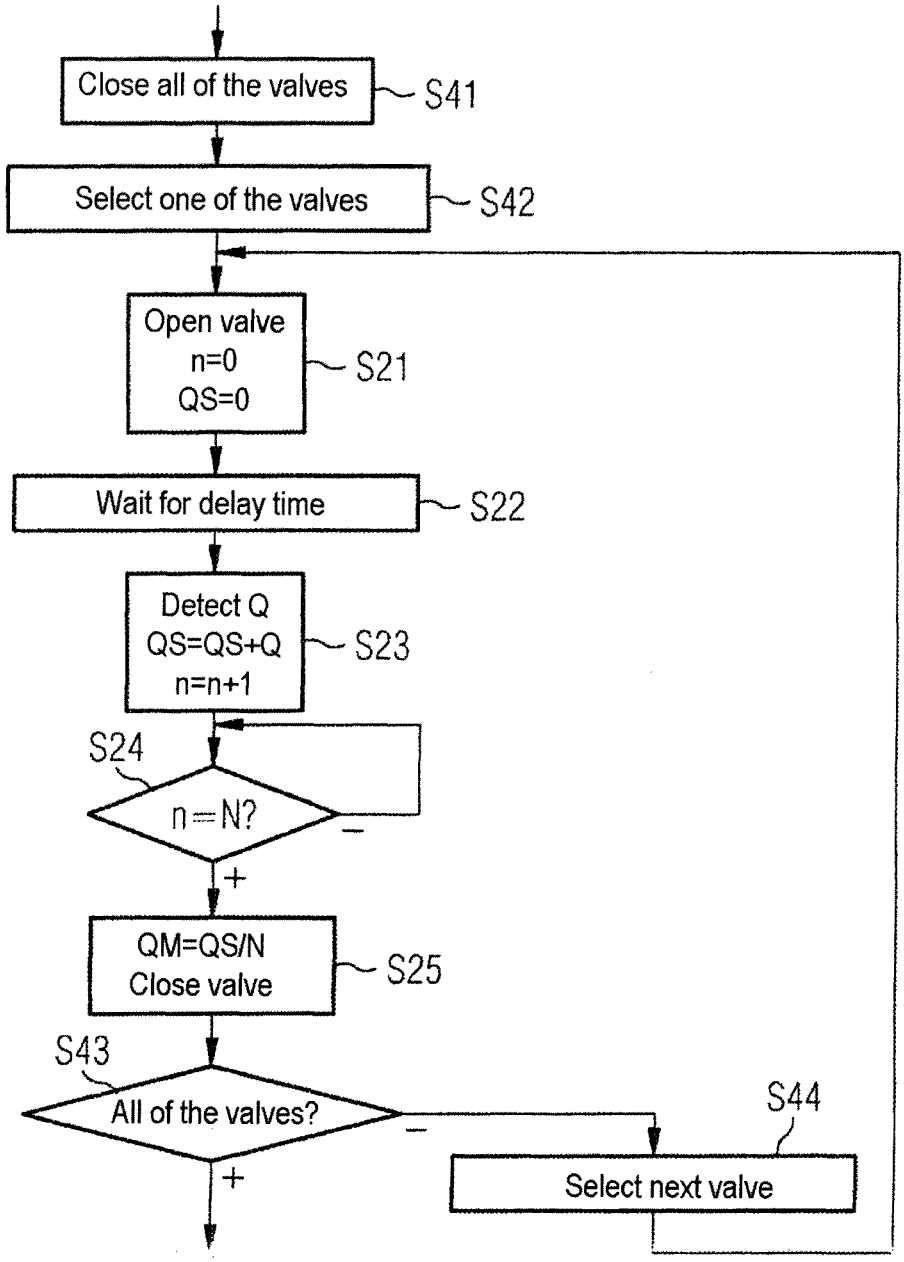
FIGS. 5 and 6 show flow diagrams.
Figure 6:
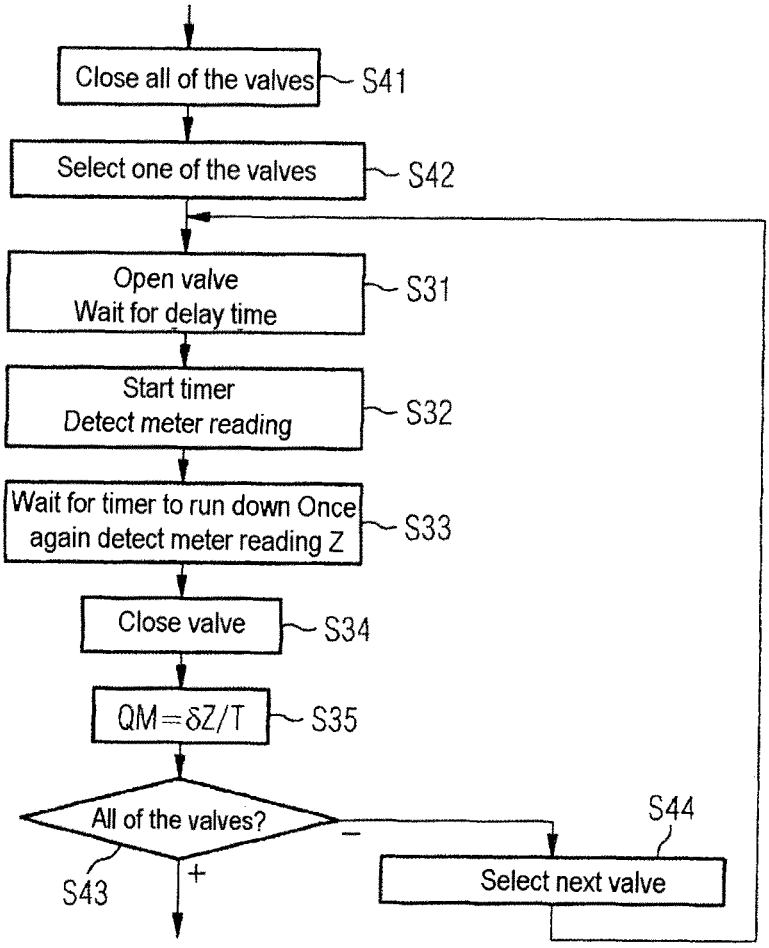

According to FIG. 5, in a step S21, the automation device 8 opens one of the valves 7. Furthermore, in step S21, it sets an index n and a sum value QS for the quantitative coolant flow Q to the value zero.

Generally, the automation device 8 then performs a step S22, in which it waits for a delay time. However, step S22 is not mandatory, but just optional.

In a step S23, the automation device 8 detects the quantitative coolant flow Q flowing at the particular time. It adds the detected quantitative coolant flow Q—likewise in step S23—to the previous sum value QS. Furthermore, in step S23, the automation device 8 increments the index n.

In a step S24, the automation device 8 checks whether the index n has already reached an end value N. If this is not the case, the automation device 8 returns to step S23. Otherwise, it goes over to a step S25. In step S25, the automation device 8 determines as the value to be entered in the valve-specific characteristic the average quantitative coolant flow QM, by dividing the sum value QS by the end value N. Furthermore, in step S25, the automation device 8 closes the respective valve 7.

The procedure from FIG. 5 may be combined with the determination of the switch-on delay T1 and the switch-off delay T2 from FIG. 3. Such a combination can be seen in particular from FIG. 4, in which the times at which the quantitative coolant flow Q is respectively detected within step S23 are also depicted.

As an alternative to the refinement from FIG. 5, it is possible according to FIG. 6 that, in a step S31, the automation device 8 opens the respective valve 7 and after that—at least preferably—waits for a delay time. Then, in a step S32, it detects at a starting time t5 a meter reading Z of a coolant meter and starts a timer.

In a step S33, the automation device 8 waits for the timer to run down and, at an end time t6, once again detects the meter reading Z.

In a step S34, the automation device 8 closes the corresponding valve 7. In a step S35, the automation device 8 forms the difference δZ between the meter readings Z and divides the difference δZ by the time period T during which the timer has run down, that is to say the difference between end time t6 and starting time t5.

Figure 7:
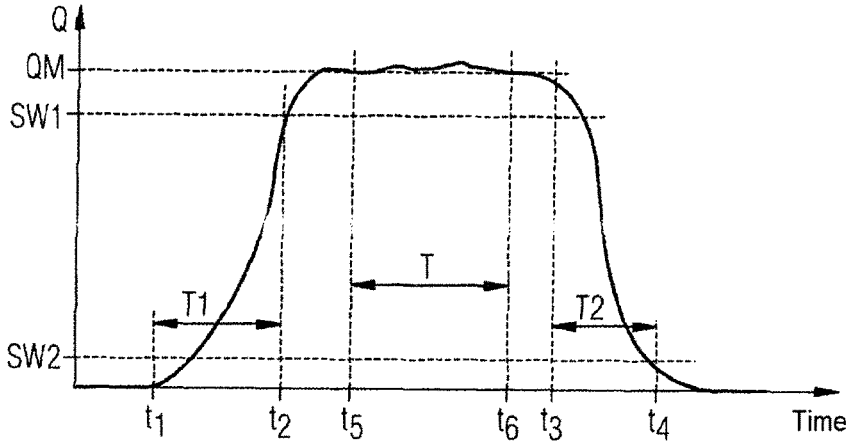
FIG. 7 shows a time diagram.

The refinement from FIG. 6 can also be combined with the determination of the switch-on delay T1 and the switch-off delay T2. This is represented in particular in FIG. 7.

It is admittedly possible in theory to provide a dedicated measuring arrangement in each branch line 5 for the detection of the quantitative coolant flows Q flowing through the respective valves 7. In this case, a parallel detection of the quantitative coolant flows Q is possible. According to various embodiments, however, in a way corresponding to FIG. 1, a measuring arrangement 12 is only provided in the main line 6. This solution is considerably less costly. In this case, to detect the quantitative coolant flow Q that flows through one of the valves 7, it must be ensured that in each case only this one valve 7 is open. All of the other valves 7 must be closed. This is so because it is only in this case that the quantitative coolant flow Q flowing in the main line 6 corresponds to the quantitative coolant flow Q flowing in the respective branch line 5. According to various embodiments, the refinements of FIGS. 3, 5 and 6 are therefore supplemented by steps S41 to S44. Steps S41 and S42 are arranged here before the core procedures of FIGS. 3, 5 and 6, steps S43 and S44 are arranged after them.

In step S41, the automation device 8 closes all of the valves 7. In step S42, the automation device 8 selects one of the valves 7. In step S43, the automation device 8 checks whether it has already performed the respective core procedure of FIGS. 3, 5 and 6 for all of the valves 7 for which it should perform the corresponding core procedure. If this is not the case, the automation device 8 selects in step S44 the next relevant valve 7 and then—for this newly selected valve 7—returns to the first step (S11, S21 or S31) of the respective core procedure.

During normal operation of the cooling section 1, generally many of the valves 7 are open at the same time, sometimes even all of the valves 7. Therefore, during normal operation, a great quantitative coolant flow Q flows through the main line 6. For this reason, the main line 6 has a large cross section, for example a pipe diameter of 1000 mm. However, the specified numerical value of 1000 mm is only given by way of example. In an individual case, the pipe diameter (or more generally the cross section) of the main line 6 may also be larger or smaller. If in the case of such a refinement only a single one of the valves 7 is open, the flow velocity of the coolant 4 in the main line 6 is very low. As a result, it is only possible with great difficulty to detect the quantitative coolant flow Q flowing in the main line 6 reliably (and in particular accurately) with only a single valve 7 open. For this reason, the main line 6 has a measuring portion 13, which has at least two individual portions 14, 15 flow-connected parallel to one another. The one individual portion 14—referred to hereafter as the main portion 14—has a large cross section, for example the normal cross section of the rest of the main line 6. The other individual portion 15—referred to hereafter as the additional portion 15—has a small cross section. For example, it may have a pipe diameter of 250, 200 or 150 mm. Here, too, however, the numerical values are to be understood as given purely by way of example. The cross section could also be larger or smaller.

The measuring arrangement 12 for detecting the quantitative coolant flow Q flowing in the main line 6 has a flow sensor 12*a*. The flow sensor 12*a* is arranged in the additional portion 15. It detects the quantitative coolant flow Q flowing in the additional portion 15.

Arranged in the main portion 14 is a main valve 16. With the main valve 16 closed, the quantitative coolant flow Q flowing in the main line 6 therefore corresponds to the quantitative coolant flow Q flowing in the additional line 15. As a result, a considerably more accurate detection of the quantitative coolant flow Q is possible in an easy way, without any adverse effects during normal operation having to be accepted.

In some cases it may be advisable during calibrating operation to activate entire groups of valves 7 simultaneously. In such cases, it may be advisable or necessary to make the coolant 4 pass through the main portion 14. In such cases, a further flow sensor 12*b* must also be arranged in the main portion 14. Furthermore, in this case an additional valve 16' should be arranged in the additional portion 15 in order to be able to shut off the additional portion 15. This is so since otherwise a number of measured values would have to be detected in parallel.

Furthermore, it may be advisable in individual cases to flow-connect in parallel more than two individual portions 14, 15, 15*x* the cross sections of the individual portions 14, 15, 15*x* generally being different from one another in pairs. In the simplest case, each individual portion 14, 15, 15*x* is respectively assigned a flow sensor 12*a*, 12*b*, 12*x* and a valve 16, 16', 16*x*. By corresponding opening and closing of the valves 16, 16', 16*x*, the effect can be achieved in this case that, at a specific time, the quantitative coolant flow Q flowing in the main line 6 must be flowing through a single one of the individual portions 14, 15, 15*x*, so that the quantitative coolant flow Q detected there corresponds to the quantitative coolant flow Q flowing altogether.

The main valve 16 is preferably closed at the beginning of calibrating operation and opened again when calibrating operation is ended (or—corresponding thereto—at the beginning of normal operation). During normal operation, the main valve 16 is kept open. It may also be necessary to open the main valve 16 for a time during calibrating operation. At least throughout normal operation, however, the main valve 16 should be kept open.

Figure 8:
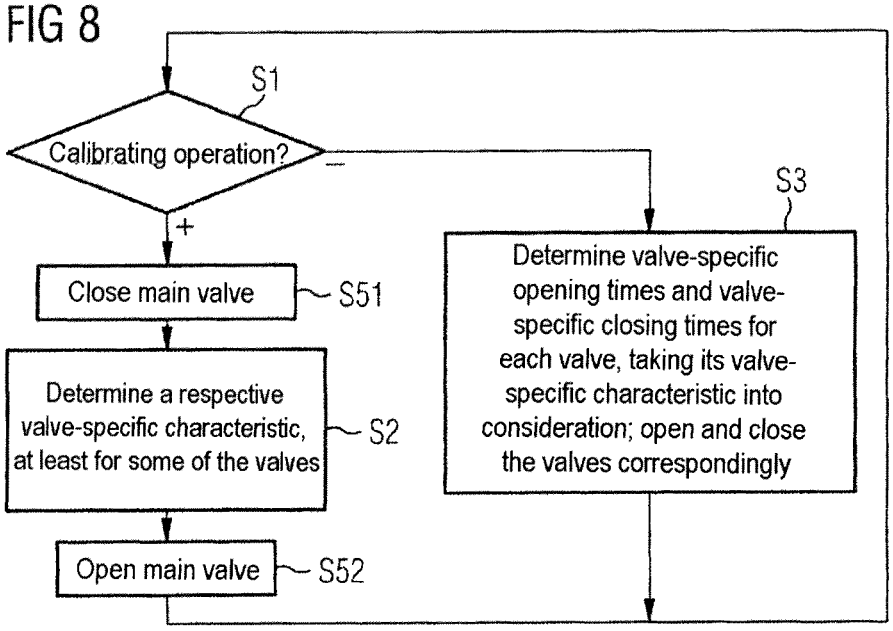
FIGS. 8 to 11 show flow diagrams.

It is possible to carry out the opening and closing of the main valve 16 manually. Preferably, however, the opening and closing of the main valve 16 is performed by corresponding activation on the part of the automation device 8. This is represented in FIG. 8. FIG. 8 represents here a modification of FIG. 2. It likewise includes steps S1 to S3, which however are supplemented by steps S51 to S52.

In step S51, the automation device 8 closes the main valve 16. In step S52, the automation device 8 opens the main valve 16.

If further valves 16', 16*x* are present in the main line 6, these valves 16', 16*x* are activated in an analogous way.

If all of the valves 7 are closed, a static pressure that builds up in the supply lines 5, 6 is relatively high. If only one or only a few valves 7 is/are open, this pressure does drop slightly, but still corresponds substantially to the static pressure. During normal operation, however, many or even all of the valves 7 are open. In this case, it may happen that the pressure present in the supply lines 5, 6 drops significantly. This pressure drop has an influence on the quantitative coolant flows Q which flow through the individual valves 7. The influence of the pressure drop is in some cases not negligible. It is therefore advisable in some cases to supplement the previously described procedures as follows:

A pressure sensor 17 is arranged in one of the supply lines 5, 6 —preferably the main line 6. The pressure sensor 17 detects the pressure present in the respective supply line 5, 6. The pressure is designated hereafter by the reference signs p and p', the reference sign p being used for the pressure p during normal operation (referred to hereafter as normal pressure p) and the reference sign p' being used for the pressure p' during calibrating operation (referred to hereafter as calibrating pressure p').

Figure 9:
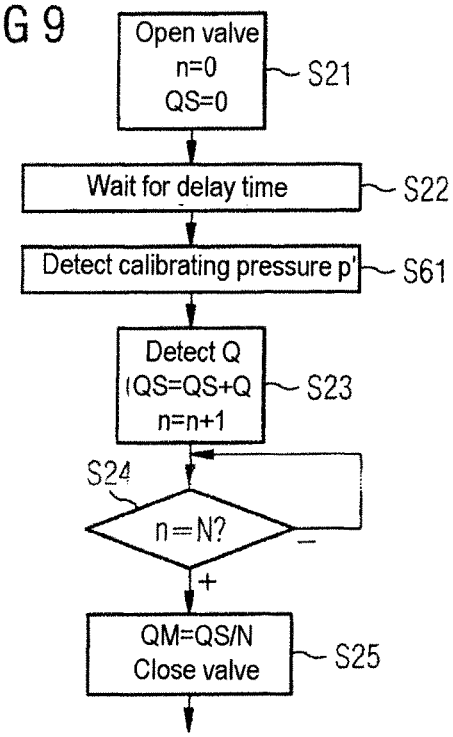
Figure 10:
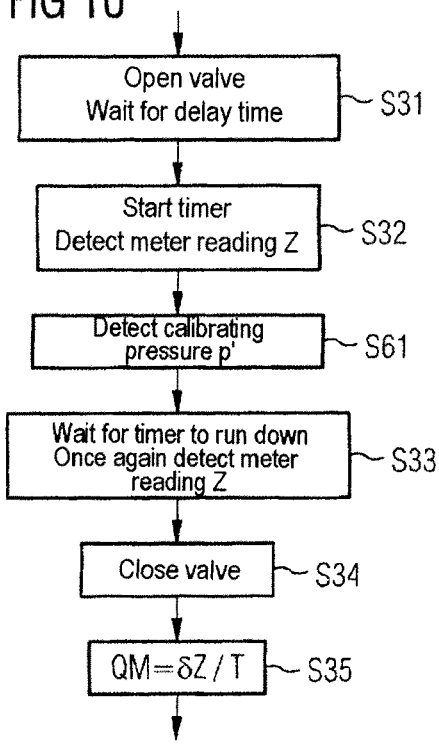

In the case of the presence of the pressure sensor 17, the procedures of FIGS. 5 and 6 may be supplemented according to FIGS. 9 and 10 by a step S61. In step S61, the automation device 8 detects the calibrating pressure p' present during calibrating operation in the respective supply line 5, 6.

Figure 11:
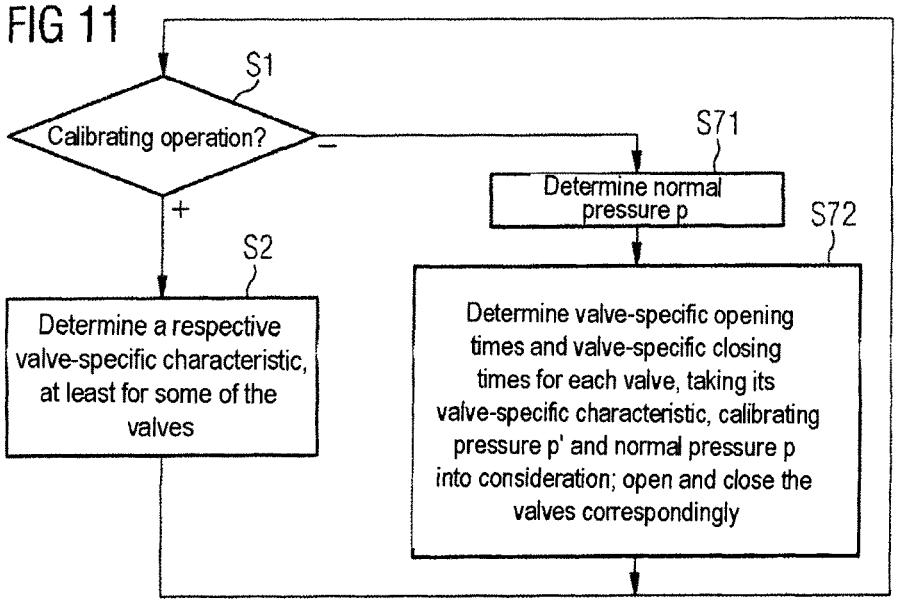

Furthermore, in this case the procedure from FIG. 2 (or FIG. 8) is modified in a way corresponding to FIG. 11 such that the step S3 is supplemented by steps S71 and S72. In step S71, the automation device 8 detects the normal pressure p present during normal operation. Step S72 corresponds in essence to step S3 from FIG. 2. In addition to the respective valve-specific characteristic of the valves 7, however, the automation device 8 also takes the calibrating pressure p' and the normal pressure p into consideration in the determination of the valve-specific opening times and the valve-specific closing times.

It is possible that the automation device 8 automatically takes over as new values the valve-specific characteristics that are determined during calibrating operation. Preferably, however, the automation device 8 indicates the determined characteristics to an operator by means of a visual display unit. The operator can in this case prescribe to the automation device 8 whether the values should be taken over or discarded. Furthermore, the operator may optionally modify the determined characteristics.

Furthermore, the automation device 8 preferably checks the determined valve-specific characteristics for compliance with tolerance ranges. If the tolerance ranges are exceeded, a warning is given.

The threshold values SW1, SW2 may be prescribed as fixed values to the automation device 8. Alternatively, they may be parameterizable or prescribed by the operator. Furthermore, it is possible for the determination of the opening time t2 and the closing time t4 to use instead of the quantitative coolant flow Q the time derivative thereof and to check at which time the change over time of the quantitative coolant flow Q falls below a limit value in terms of its amount.

Furthermore, it is possible to make the opening time period T and the end value N fixed or parameterizable.

In a further embodiment, it is possible to determine the valve-specific characteristics not only for individual valves 7 but also for entire valve groups (for example every second valve 7, every third valve 7, etc.). In particular in this case, as already mentioned, it may also be necessary to have the further flow sensor 12*b* in the main portion 14 and the additional valve 16' in the additional portion 15.

Furthermore, the reliability of the calibration can be increased if, in addition to the detected quantitative coolant flows Q, the automation device 8 is additionally fed check-back indications from the valves 7, 16, 16'. On the basis of these check-back indications it can be ascertained, for example, that the respective valve 7, 16, 16' is in one of its end positions (completely open or completely closed).

The automation device 8 also preferably carries out plausibility checks and, if need be, issues warnings to the operator.

Finally, it is possible that the operator prescribes to the automation device 8 with respect to which of the valves 7 the determination of the valve-specific characteristic is to be performed. For example, the operator may mark individual valves 7 or valve groups as defective and so exclude them from the determination of the valve-specific characteristic or, conversely, actually call for the determination of the respective valve-specific characteristics with respect to individual valves 7 or valve groups.

A procedure in which the automation device 8 automatically determines the valve-specific characteristics during calibrating operation has been explained above. However, it is possible that, although the automation device 8 performs the activation of the valves 7 (and possibly also the valves 16, 16', 16*x*) and the detection of the relevant measured values Q, t2, t4, the determination of the valve-specific characteristics itself is performed by the operator. Furthermore, it is also possible to perform only the activation of the valves 7 (and possibly also the valves 16, 16', 16*x*) by means of the automation device 8. In this case, for example, the variation over time of the quantitative coolant flow Q could be detected by means of the measuring arrangement 12 and output to the operator. For example, the recording could take place on paper. In this case, the operator would have to perform both the determination of the relevant times t2, t4 and the comparison with the threshold values SW1, SW2 and also read off himself the quantitative coolant flows Q. In this case, the determination of the valve-specific characteristics also would not be performed in an automated manner by the automation device 8. Furthermore, it is possible that even the activation of the valves 7 (and possibly also the other valves 16, 16', 16*x*) is not performed in a fully automated manner but is only ever performed if the automation device 8 is given a corresponding control command by the operator.

The above description serves exclusively for explaining the present invention. On the other hand, the scope of protection of the present invention should be determined exclusively by the appended claims.

What is claimed is:

1. A method for automatic operation of a cooling section, wherein the cooling section comprises a plurality of coolant outlets for applying a coolant to a rolling stock passing through the cooling section, the method comprising the steps of:

supplying the plurality of coolant outlets with the coolant via a plurality of branch lines, in each of which a valve is arranged, wherein individually opening and closing the plurality of valves supplies the coolant to the coolant outlets selectively for each respective branch line;

supplying the plurality of branch lines with the coolant via a main line shared by all of the respective branch lines;

calibrating operation of the cooling section by determining a valve-specific characteristic for at least one ot the plurality of valves, by:

opening and closing the respective valve and detecting a resultant variation over time of a quantitative coolant flow by measuring a volume flow of coolant in the main line; and detecting a calibrating pressure prevaling in the respective supply line;

determining a valve-specific opening time and a valve-specific closing time for the at least one of the plurality of valves, based at least in part on the determined valve-specific characteristic, a normal pressure prevailing in the respective supply line during normal operation, and the detected calibrating pressure; and opening and closing the plurality of valves, using an automated device, at the determined valve-specific opening times and the determined valve-specific closing times during normal operation of the cooling section to apply coolant to the rolling stock in accordance with a predetermined variation in coolant quantities;

wherein the respective valve-specific characteristic comprises an average quantitative coolant flow which, with the respective valve open, flows through the respective valve.

2. The operating method according to claim 1, wherein the respective valve-specific characteristic comprises at least one of a switch-on delay and a switch-off delay.

3. The operating method according to claim 2, wherein, to determine the switch-on delay of one of the valves, the automation device issues an opening command, with the respective valve closed, to the respective valve at a first activating time, wherein the quantitative coolant flow flowing in the main line is detected and in that the switch-on delay is determined on the basis of the first activating time and the detected quantitative coolant flow.

4. The operating method according to claim 2, wherein, to determine the switch-off delay of one of the valves, the automation device issues a closing command, with the respective valve open, to the respective valve at a second activating time, wherein the quantitative coolant flow flowing in a main line is detected and wherein the switch-off delay is determined on the basis of the second activating time and the detected quantitative coolant flow.

5. The operating method according to claim 1, wherein, to determine the average quantitative coolant flow of one of the valves, the quantitative coolant flow flowing through the main line is repeatedly detected during an opening time period and wherein the average quantitative coolant flow is determined by calculating a mean value of the detected quantitative coolant flows.

6. The operating method according to claim 1, wherein, to determine the average quantitative coolant flow of one of the valves, an amount of coolant that has flowed through the main line is detected at the beginning and at the end of an opening time period and wherein the average quantitative coolant flow is determined by forming the difference between the amount of coolant detected at the beginning of the opening time and the amount of coolant detected at the end of the opening time and dividing the difference by a duration of the opening time period.

7. The operating method according to claim 1, wherein calibrating operation is carried out by the automation device in an automated manner.

8. An operating program product comprising a non-transitory computer readable medium which comprises machine code, the execution of which by an automation device for a cooling section brings about the effect that the automation device performs an operating method as claimed in claim 7.

9. An automation device for a cooling section, the automation device being programmed with an operating program comprising machine code, which when executed by the automation device brings about the effect that the automation device performs an operating method as claimed in claim 7.

10. A cooling section comprising an automation device according to claim 9, and further comprising a plurality of coolant outlets, by means of which a coolant can be applied to a rolling stock passing through the cooling section during normal operation of the cooling section, wherein the coolant outlets can be supplied with the coolant via supply lines, wherein the supply lines comprise branch lines, in each of which a valve is arranged, wherein the valves can individually open and close, so that by means of the valves the supply of coolant to the coolant outlets can be established and interrupted branch line by branch line, wherein the branch lines can be supplied with the coolant via a main line shared by the branch lines.

11. A method for automatic operation of a cooling section, wherein the cooling section comprises a plurality of coolant outlets for applying a coolant to a rolling stock passing through the coolant section, the method comprising the steps of:

supplying the pluralilty of coolant outlets with the coolant via a plurality of branch lines, in each of which a valve is arranged, wherein individually opening and closing the plurality of valves supplies the coolant to the coolant outlets selectively for each respective branch line;

supplying the plurality of branch lines with the coolant via a main line shared by all of the respective branch lines;

calibrating operation of the cooling section by determining a valve-specific characteristic for at least one of the plurality of valves, by opening and closing the respectibe valve and detecting a resultant variation over time of a quantitative coolant flow by measuring a volume flow of coolant in the main line; and determining a valve-specific opening time and a valve-specific closing time for the at least one of the plurality of valves, based at least in part on the determined valve-specific characteristic; and opening and closing the plurality of valves, using an automated device, at the determined valve-specific opening times and the determined valve-specific closing times during normal operation of the cooling section to apply coolant to the rolling stock in accordance with a predetermined variation in coolant quantities;

wherein the main line comprises:

a measuring portion including at least two individual portions flow-connected parallel to one another, one of which has a large cross section and the other has a small cross section;

a measuring arrangement including a flow sensor, arranged in the individual portion with the small cross section, for detecting the quantitative coolant flow flowing in the individual portion with the small cross section; and a main valve disposed at least in part in the individual portion with the large cross section;

wherein at the beginning of normal operation of the cooling section the main valve is opened and kept open during normal operation of the cooling section; and wherein during calibrating operation of the cooling section the main valve is closed, at least for a time, so that the quantitative coolant flow flowing in the main line with the main valve closed corresponds to the quantitative coolant flow flowing in the individual portion with the small cross section.

* * * * *